US005190464A

United States Patent [19]

Chow et al.

[11] Patent Number: 5,190,464

[45] Date of Patent: Mar. 2, 1993

[54] SHIELDED ELECTRICAL CONNECTOR WITH CONTACT SHUNTING ARRANGEMENT

[75] Inventors: Hsiu-Shen Chow, Pan-Chiao, Taiwan; Leonard Ellentuch, Wallkill, N.Y.

[73] Assignees: Chian Chyun Enterprise Co. Ltd., Taipei Hsien, Taiwan; Resco, Inc., Newburgh, N.Y.

[21] Appl. No.: 895,185

[22] Filed: Jun. 5, 1992

Related U.S. Application Data

[63] Continuation of Ser. No. 677,218, Mar. 29, 1991, abandoned.

[51] Int. Cl.[5] ..... H01R 29/00

[52] U.S. Cl. ..... 439/188; 439/289; 439/292; 439/607

[58] Field of Search ..... 439/188, 287, 289, 292, 439/293, 295, 513–515, 607

[56] References Cited

U.S. PATENT DOCUMENTS

| | | | |
|---|---|---|---|
| 4,501,459 | 2/1985 | Chandler et al. | 439/289 |
| 4,602,833 | 7/1986 | Grabbe et al. | 439/292 |
| 4,653,825 | 3/1987 | Olsson | 439/289 |
| 4,682,836 | 7/1987 | Noorily et al. | 439/607 |
| 4,871,323 | 10/1989 | Ohsuni | 439/188 |
| 5,030,121 | 7/1991 | Noorily | 439/188 |
| 5,123,854 | 6/1992 | Petersen et al. | 439/188 |

*Primary Examiner*—Paula A. Bradley

*Attorney, Agent, or Firm*—Sprung Horn Kramer & Woods

[57] ABSTRACT

A shielded electrical connector comprises an insulating terminal housing formed of a base member and a cover member. The housing has a front mating face, a rear wire-connecting face and a terminal supporting platform extending between the two faces. Four electrical terminals are mounted on the terminal supporting platform with contact portions disposed in the area of the mating face and wire-connecting portions disposed in the area of the wire-connecting face. Each contact portion includes a resilient contact tongue spaced from the platform and having a free end extending away from the mating face. Each contact tongue is matable against a corresponding contact tongue of the complementary connector to urge the contact tongues toward the respective platforms from which they are supported. An electrical shunting device is fixedly mounted in the housing and disposed adjacent to the contact tongues in the area of the free ends thereof. The shunting device engages preselected contact tongues when the connector is in an unmated condition and is spaced from the contact tongues when the connector is in a mated condition. The shunting device comprises an insulative, substantially planar surface having four conductive contact pads arranged thereon facing the terminals. Each contact pad is oriented adjacent a respective one of the contact tongues such that contact between each pad and its respective, adjacent contact tongue is made in substantially the same relative position on all contact tongues.

15 Claims, 4 Drawing Sheets

FIG.2
PRIOR ART
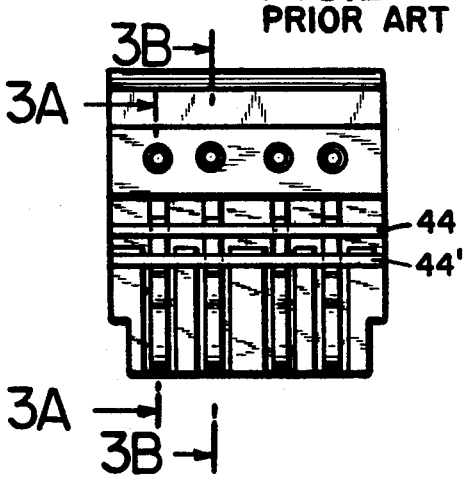
FIG.2A
PRIOR ART
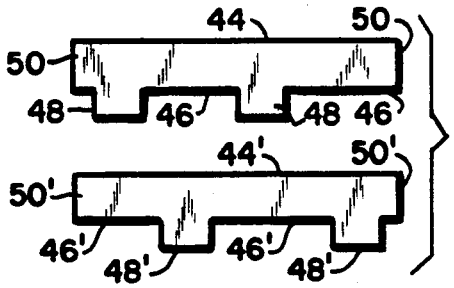
FIG.3A
PRIOR ART
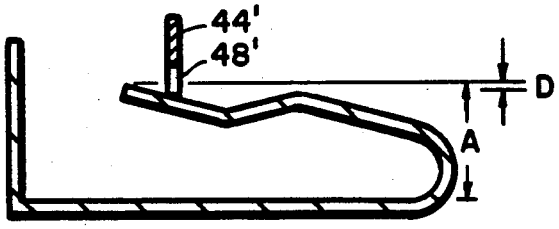
FIG.3B
PRIOR ART
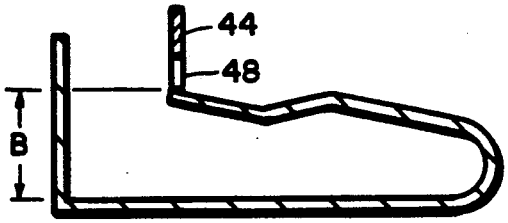
FIG.4
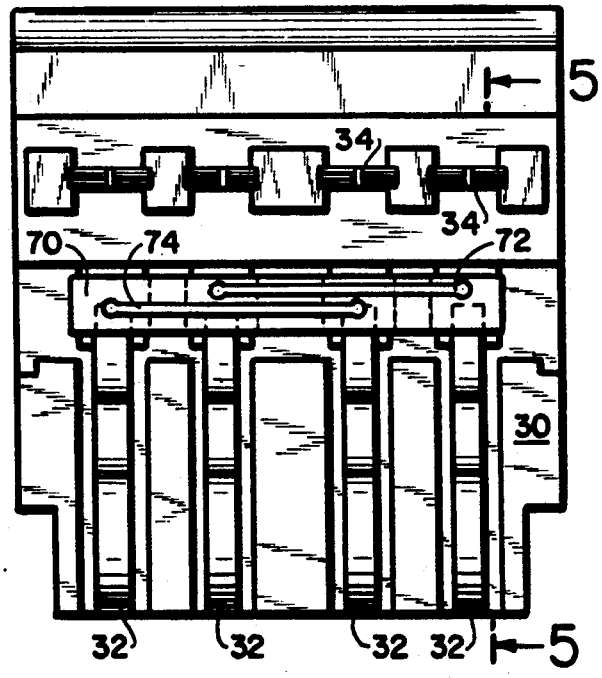
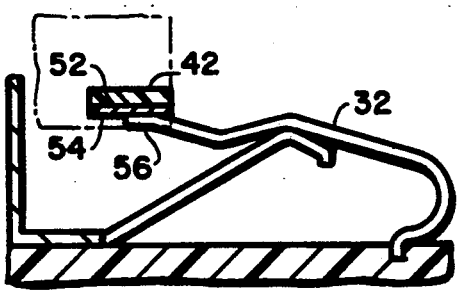
FIG.5

FIG.5A
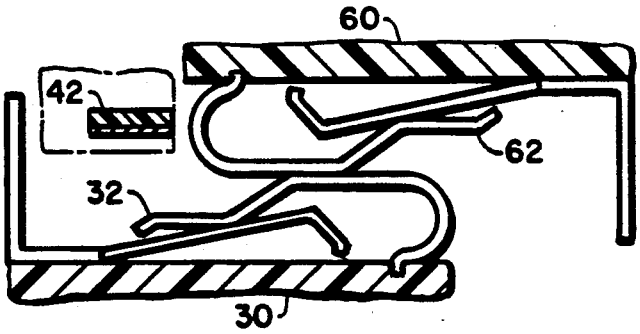
FIG.6A
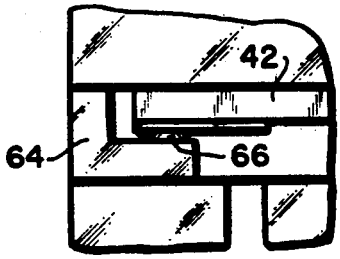
FIG.6
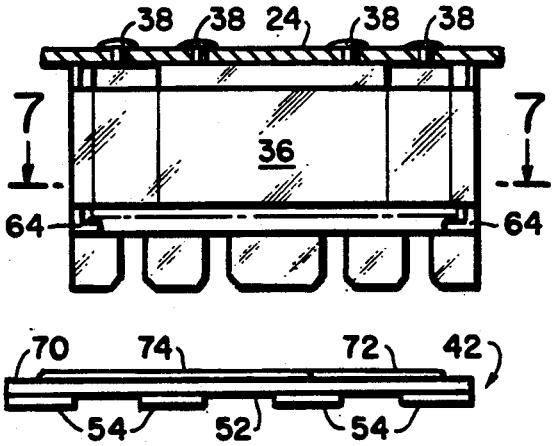
FIG.7
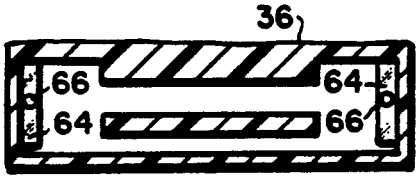
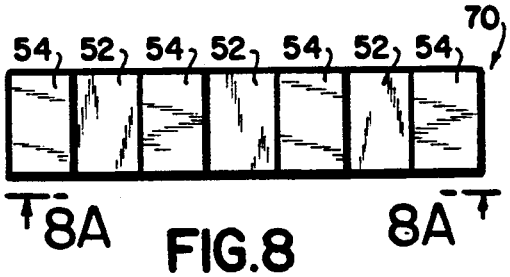
FIG.8
FIG.8A
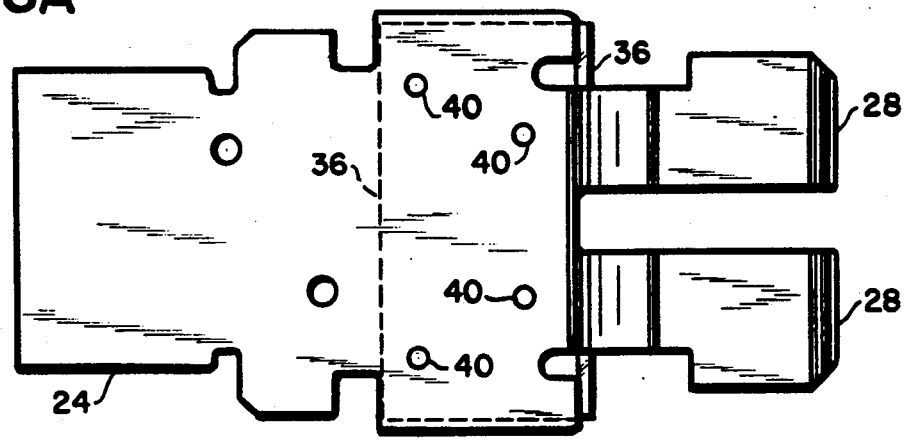
FIG.9

SHIELDED ELECTRICAL CONNECTOR WITH CONTACT SHUNTING ARRANGEMENT

This application is a continuation of application Ser. No. 677,218, filed Mar. 29, 1991, now abandoned.

BACKGROUND OF THE INVENTION

The present invention relates to a shielded electrical connector and, more particularly, to a hermaphroditic electrical connector for mating with a complementary hermaphroditic electrical connector. More specifically, the invention relates to an electrical connector of this type which incorporates means for shunting alternate electrical contacts when the connector is unmated with another connector.

With the ever increasing use of data communications equipment, there is a growing need for electrical connectors for terminating electrical cables and for connecting data equipment, or components thereof, to each other. Electrical connectors of the type used for data communications equipment are disclosed, for example, in the U.S. Pat. Nos. 4,449,778 and 4,501,459 (reissued as U.S. Pat. No. Re. 32,760). These connectors comprise an insulating terminal housing formed of a base member and a cover member and having a front mating face for connection to a complementary connector and a rear wire-connecting face for connection to an electrical cable. A parallel row of four electrical terminals is mounted on a terminal supporting platform that extends between the front and rear faces of the housing. These terminals are configured at one end to mechanically and electrically connect to an insulated wire and configured at the other end to contact another, like terminal, for example of a complementary electrical connector. Each terminal comprises a resilient contact tongue spaced from the terminal supporting platform and having a free end extending away from the mating face. Each contact tongue is matable against a corresponding contact tongue of the complementary connector to urge the contact tongues toward the respective platforms from which they are supported.

The aforementioned U.S. Pat. Nos. 4,449,778 and 4,501,459 also teach the provision of means for shunting alternate electrical contacts when the connector is unmated with another, complementary connector. This shunting, or interconnection of the open contacts prevents spurious electrical signals, such as may occur by misconnection or from static electricity, from harming the attached computer equipment.

The shunting is effected by two "shunting bars" which bridge the electrical contact terminals to be shunted. One shunting bar connects the first and third contacts together while the other shunting bar connects the second and fourth contacts together. When the connector is mated with another, complementary connector, the electrical contact tongues are forced away from the shunting bars, thus breaking the shunt circuits.

The U.S. Pat. No. 4,682,836, discloses a similar connector arrangement wherein the shunting bars are replaced by shunting wires which have a "C" shaped configuration. The shunting bars and the shunting wires are arranged in parallel, side by side, perpendicular to the contact terminals. As a result of this tandem arrangement, one shunting bar or wire contacts two of the contact tongues at a different, relative location than the other. In particular, the contact points of two of the contact tongues are nearer the tongues' free ends than the other. Since the tongues contact the respective shunting bars or wires at an angle, two of the contact tongues are depressed to a greater extent by the shunting bars or wires than the other two contact tongues. Over a long period of use, the resilient characteristics of two contact terminals vary with respect to the other two so that, over time, the connector becomes less reliable.

An additional problem with the known arrangements for shunting the contacts is the minimal contact area provided by the shunting bars or shunting wires. The bars and wires make essentially a point contact with the contact tongues so that the resistance at the point of contact is unnecessarily high.

Finally, the assembly of the known connectors by the user is unnecessarily complicated. Such connectors are normally furnished as a "bag of parts" which require knowledge and skill to assemble in the field. For example, the connector disclosed in the U.S. Pat. No. 4,501,459, mentioned above, requires that the two shunting bars be separately mounted into the housing before the housing is assembled together and closed by the cover. Similarly, in the case of the connector disclosed in the U.S. Pat. No. 4,682,836, mentioned above, the U-shaped shunting wires must be inserted in a holding block, and this block must then be attached to the contact holder which, in turn, is inserted in the housing. Particularly since the connector parts are small and easily dropped or lost in the field, such assembly is less than satisfactory.

SUMMARY OF THE INVENTION

It is a principal object of the present invention to provide a shielded electrical connector with a contact shunting arrangement that insures that the shunting contacts are always in the same relative position with respect to the contact tongues.

It is a further object of the present invention to provide a shielded electrical connector with a contact shunting arrangement that affords a maximum contact area with the individual contact tongues.

It is a further object of the present invention to provide a shielded electrical connector with a contact shunting arrangement which is substantially simpler to assemble in the field than prior known conductors of this type.

These objects, as well as other objects which will become apparent from the discussion that follows, are achieved, in accordance with the present invention, by providing a shielded electrical connector of the aforementioned type with a shunting device formed of an insulated, substantially planar surface on which are mounted a plurality of conductive contact pads, each facing a separate one of the electrical terminals. The contact pads are arranged in a row, with each contact pad oriented adjacent a respective one of the contact tongues, such that the contact between each pad and its respective, adjacent contact tongue is made in substantially the same relative position on all the contact tongues.

The contact pads on the insulated planar surface are separated, and thus insulated from each other. There being four contact pads, they are electrically connected in pairs to serve their shunting function.

In accordance with the preferred embodiment of the present invention, the insulated planar surface, referred to above, is formed by a planar substrate such as a printed circuit board and the electrical conductors, which interconnect the pairs of contact pads, are disposed on the opposite side of the substrate than the contact pads. Preferably, the interconnecting electrical conductors extend through holes in the substrate to make connection to the contact pads.

In order to simplify the assembly of the electrical connector, the electrical shunt as well as an insulated wire holding block is attached to the cover member. When the connector is assembled, the individual wires are inserted in wire retention slots in the holding block. Thereafter, the housing cover, together with the attached holding block and shunting device, are placed on top of the housing as a unit, thereby placing the shunting device in position with respect to the contact tongues and placing the wires individually into mechanical and electrical engagement with the wire-connecting portions of the electrical terminals.

The cover member, as well as the base member of the housing are each provided with a conductive electrical shield. This shield has contact portions which are matable with complementary contact portions of the electrical shield on a complementary connector. According to a particular feature of the present invention, the shunting device is mounted on the wire holding block, the holding block is attached to the upper electrical shield, and the upper shield is, in turn, attached to the housing cover. These various parts are preassembled at the factory so that they may be joined together by the user in the field with the base portion of the housing as a single unit. This arrangement substantially simplifies the assembly of the connector in the field.

The preferred embodiments as well as further features and advantages of the present invention will now be described with reference to the accompanying drawings.

BRIEF DESCRIPTION OF THE DRAWINGS

FIG. 2 is a top view of a contact support platform with two shunt bars in position as they are known in the prior art.

FIG. 2A is a plan view of the two shunt bars shown in FIG. 2.

FIG. 3A is a cross-sectional view of an electrical contact and a shunt bar a taken along the line 3A—3A in FIG. 2.

FIG. 3B is a cross-sectional view of an electrical contact and a shunt bar as taken along the line 3B—3B in FIG. 2.

FIG. 4 is a top view of a contact support platform and a shunting device in accordance with the present invention.

FIG. 5 is a cross-sectional view of an electrical contact terminal taken along the line 5—5 in FIG. 4.

FIG. 5A is a cross-sectional view of an electrical contact terminal in mated relationship with a complementary contact terminal.

FIG. 6 is a front end view of a wire retention and shunting device holding block in accordance with the preferred embodiment of the present invention.

FIG. 6A is a detailed end view of a portion of the holding block and shunting device shown in FIG. 6.

FIG. 7 is a cross-sectional view of the holding block taken along the line 7—7 in FIG. 6.

FIG. 8 is a plan view of the shunting device according to the preferred embodiment of the present invention.

FIG. 8A is a side view of the shunting device of FIG. 8.

FIG. 9 is a plan view of an upper electrical shield for use with the connector in accordance with the present invention.

DESCRIPTION OF THE PREFERRED EMBODIMENT

Figure 1:
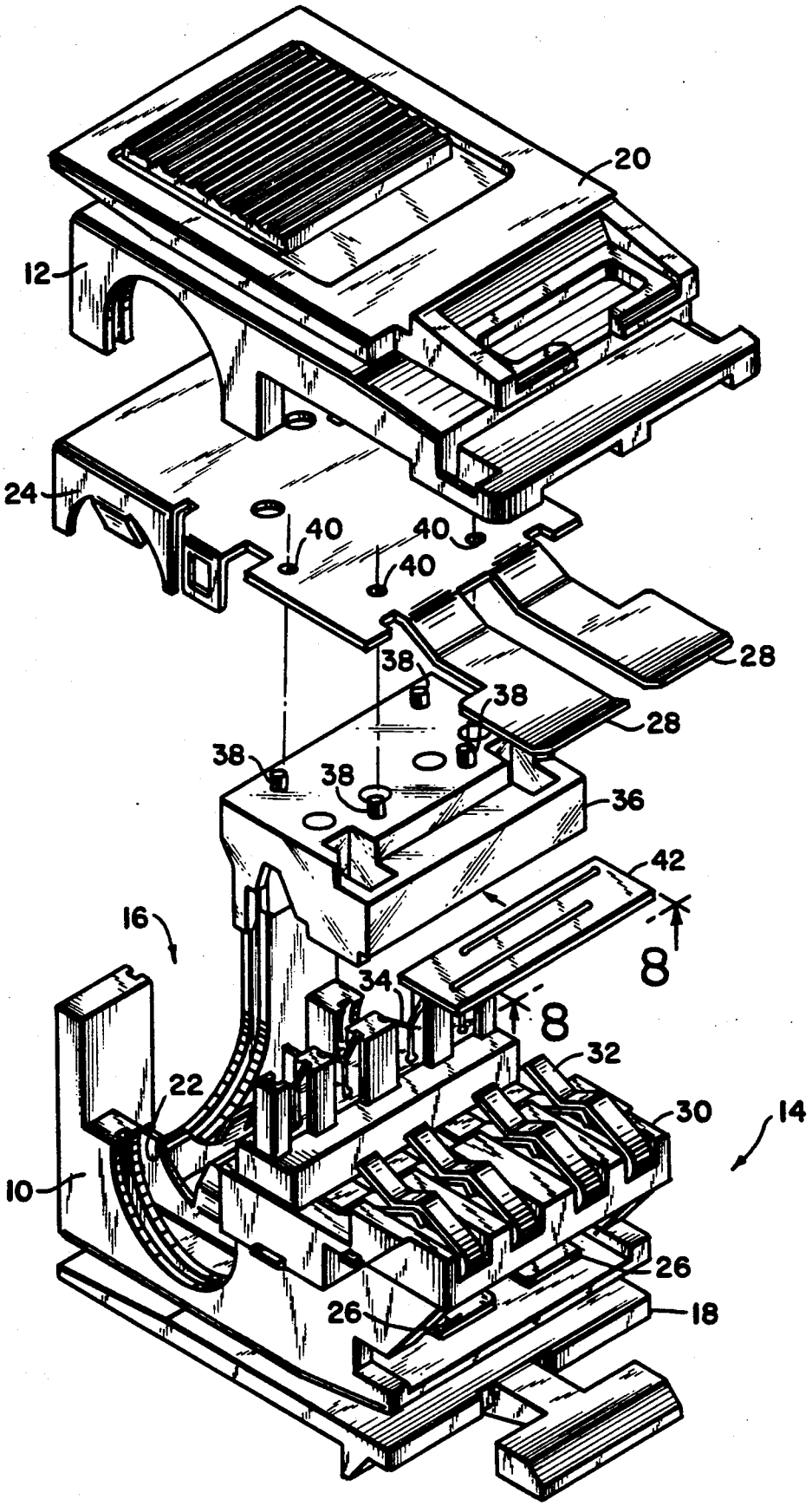
FIG. 1 is an exploded, perspective view of an electrical connector in accordance with the present invention.

The preferred embodiment of the present invention will now be described with reference to FIGS. 1–11 of the drawings. Identical elements shown in the various figures are designated with the same reference numerals.

Figure 10:
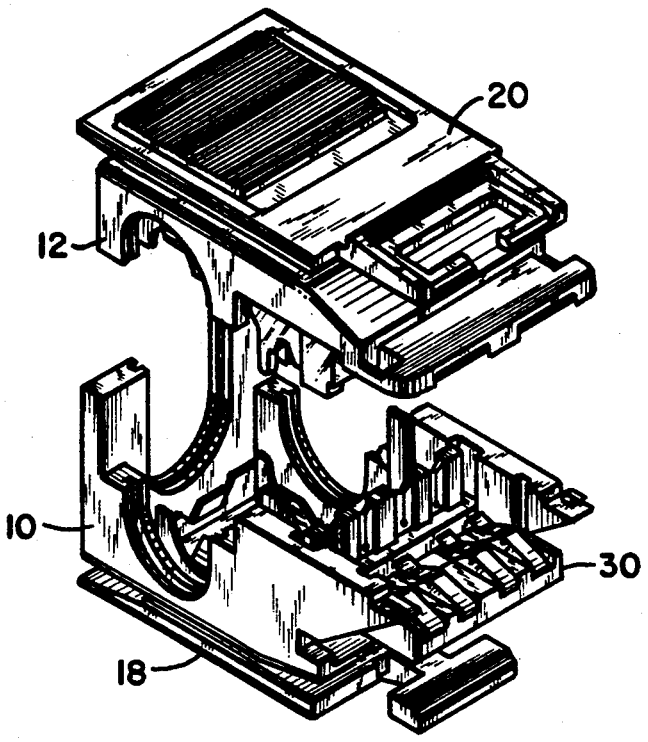
FIG. 10 is a perspective view of the two separately assembled parts of the electrical connector in accordance with the present invention.
Figure 11:
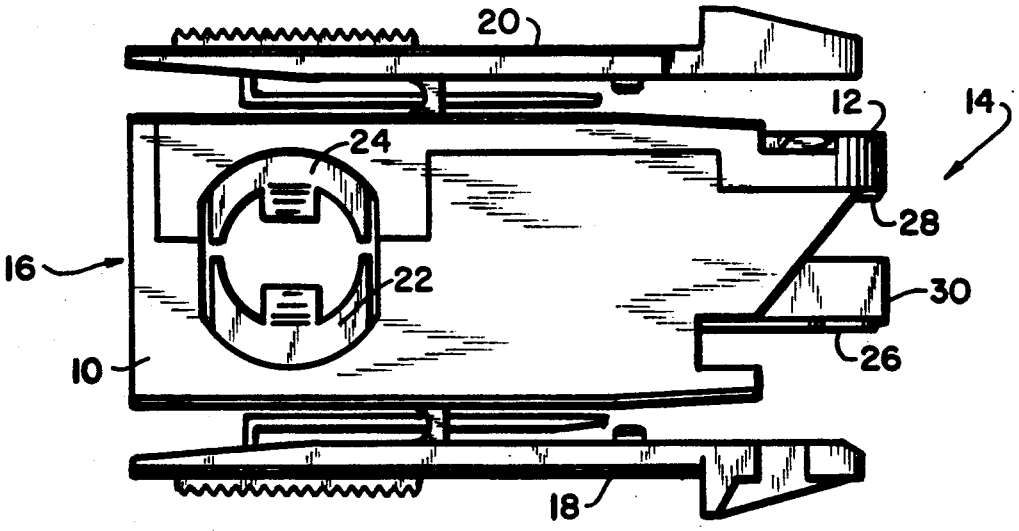
FIG. 11 is a side view of the electrical connector of FIG. 10 showing the two parts in assembled relationship.

FIG. 1 shows, in exploded view, the preferred embodiment of the connector according to the invention. Details of this connector are also shown in FIGS. 4, 5, 5A, 6, 6A, 7, 8, 8A and FIG. 9. FIGS. 10 and 11 show the connector in assembled form in perspective and side views, respectively.

Referring to these figures, we find the connector comprises an insulating terminal housing formed of a base member 10 and a cover member 12. The housing has a front mating face 14 and a rear wire-connecting face 16. The housing is adapted to mate with another, similar hermaphroditic connector which is held in coupling relationship by means of a latching member 18 attached to the housing 10 and a latching member 20 attached to the cover member 12. This arrangement for interlocking two hermaphroditic connectors is well known and is disclosed, for example, in the aforementioned U.S. Pat. No. 4,449,778. Details of the particular latching device shown in FIGS. 1, 10 and 11 are also disclosed in the commonly-owned patent application Ser. No. 07/657,912 [Attorney docket RESCO-201].

A conductive electrical shield is arranged within the housing to surround the electrical components therein. The shield comprises a first portion 22 attached to the housing base member and a second portion 24 attached to the cover member. The electrical shield has contact elements 26 on the first portion 22, and contact elements 28 on the second portion 24 which mate with complementary contact portions of the electrical shield in a complementary electrical connector. An electrical shield of the type employed in this connector is disclosed, for example, in the aforementioned U.S. Pat. No. 4,449,778.

Arranged within the housing, between the front mating face 14 and the rear wire-connecting face 16, is an insulating terminal supporting platform 30. This platform carries four electrical terminals with contact portions 32 arranged in the area of the mating face 14 and wire-connecting portions 34 arranged in the area of the wire-connecting face 16. Each wire-connecting portion 34 has an insulation displacement portion for making electrical engagement with an insulation-covered wire. Details of electrical terminals of this type may be found in the aforementioned U.S. Pat. Nos. 4,449,778 and 4,501,459. The electrical contacts shown in FIGS. 1, 4, 5 and 5A are disclosed in the commonly-owned U.S. patent application Ser. No. 07/657,914

Sandwiched between the terminal platform 30 and the upper portion of the electrical shield 24 is an electrically insulative (e.g. plastic) wire holding block 36. This holding block is attached to the upper shield portion 24 by means of four small projections or "pegs" 38 which extend through holes 40 in the shield 24 and are upset or flanged over on the opposite side of the shield. The purpose of this holding block is twofold: (1) to receive and hold the four cable wires prior to their engagement with the wire-connecting portions of the electrical terminals, and (2) to support a printed circuit board 42 which serves as a shunting element to provide a connection between alternate ones of the electrical terminals.

A holding block, similar to the holding block 36, is disclosed in the aforementioned U.S. Pat. Nos. 4,501,459 and 4,682,836. In these known connector configurations, however, the holding block is provided as a separate element in a bag of parts for assembly by the user. The user is required to insert the ends of the cable wires in the wire retention slots and then place the holding clock into the connector housing in such a way that the wires engage the electrical terminals.

With the present invention, however, the holding block is permanently attached to the upper portion of the electrical shield 24 which, in turn, is attached to the cover 12 of the housing. After inserting the wires in the wire retention slots of the block 36, the entire unit—that is, the assembled cover member—is then simply clamped to the base member of the housing.

Accordingly, instead of assembling a "bag of parts" in the field, the user must simply snap together two preassembled parts, which are shown separate and apart in FIG. 10 and shown in assembled form in FIG. 11.

As mentioned above, the holding block 36 also retains a device 42 for shunting alternate ones of the electrical terminals, when the connector is not mated with a complementary connector. This shunting device 42 will now be described in detail.

The aforementioned U.S. Pat. No. 4,501,459 discloses a shunting arrangement, disposed adjacent to the contact tongues of the electrical terminals in the area of free ends thereof, for selectively shunting alternate electrical terminals. The shunting arrangement engages preselected contact tongues when the connector is in an unmated condition, and is spaced from the preselected contact tongues when the connector is in a mated condition. This known arrangement for shunting the electrical terminals is illustrated in FIGS. 2, 2A, 3A and 3B.

As is illustrated in FIGS. 2 and 2A, the shunting arrangement consists of two identical shunting bars 44 and 44' which are stamped from single pieces of sheet metal with spaced apertures 46 and 46' defining between them contact lugs 48 and 48', respectively, extending from a central bridge potion. Tabs 50 and 50', respectively, extend from the ends of each shunting bar.

These shunting bars 44 and 44' are mounted with their tabs 50 and 50' received in corresponding slots in the base member 10 of the housing. The apertures 46 of one shunting bar 44 are aligned with the contact lugs 48' of the other shunting bar 44' because of the assymetric location of the apertures, with the result that the contact lugs 48 engage the free ends or tips of the first and third contact tongues and the contact lugs 48' engage the free ends of second and fourth contact tongues.

FIGS. 3A and 3B illustrate, in side view, how and where the shunting bars 44 and 44' contact their respective contact tongues. As shown in FIG. 3B, the lugs 48 of the shunting bar 44 touch the very tips of their respective contact tongues with a point contact, whereas the lugs 48' of the shunting bar 44' touch their contact tongues with a point contact at some distance away from their free ends. As may be seen, the two contact bars do not make contact with their respective contact tongues at precisely the same position.

Since the shunting bars 44 and 44' are mounted in the housing at the same elevation, the shunting bar 44 depresses its contact tongues to a greater extent than does the shunting bar 44'. Consequently, the maximum height of the tips of the contact tongues which are depressed by the contact lugs 48', indicated by the distance A in FIG. 3A, is greater than the maximum height of the tips of the contact tongues depressed by the contact lugs 48, indicated by the distance B in FIG. 3B. This difference D, where $D=A-B$, is retained over time and long use of the connector by the "shape memory" of the electrical terminals. As a consequence, the electrical terminals produce a varying contact force against the shunt bars and, when the connector is connected to a complementary connector, to the complementary contact tongues.

FIGS. 4 and 5 illustrate the preferred embodiment of the solution to this problem. FIG. 4 is a top view of the terminal platform 30 in the connector of FIG. 1. FIG. 5 is a cross-sectional view through the platform 30 showing one electrical terminal 32 in side view. The two-piece construction of the electrical terminal 32 is disclosed in detail in the commonly-owned U.S. patent application Ser. No. 07/657,914. This two piece construction is preferred, but not required for the utilization of the present invention.

According to the invention, there is provided a shunting device 42 which comprises an insulative, substantially planar surface 52 having four conductive contact pads 54 arranged thereon on a common straight line and facing the electrical terminals. Each contact pad is oriented adjacent a respective one of the contact tongues such that the area of contact 56 between each pad and its respective adjacent contact tongue is made in substantially the same relative position on all contact tongues with the several contact areas arranged on a common line. In addition, the area of contact 56 between each contact pad and its respective contact tongue is relatively large. Consequently, all of the contact tongues are depressed by the shunting device 52 in exactly equal measure. This permits the contact force to be optimized for all electrical terminals, thus extending the life of the electrical connector.

FIG. 5A illustrates how the contact tongue 30 becomes separated from the shunting device 42 when the electrical connector providing the terminal platform 30 is mated with a complementary electrical connector. In FIG. 5A, the terminal platform of the complementary connector is designated by the reference numeral 60 and the contact tongue of the complementary connector is designated by 62.

The shunting device 42, and the arrangement for holding this shunting device in position in the connector, are illustrated further in FIGS. 6–9.

FIG. 6 is a front view of the holding block 36 which is attached to the conductive shield 24 by the flanged lugs 38. The shunting device 42 is retained by L-shaped guides 64 which protrude from the bottom of the holding block on either side thereof. FIG. 6A illustrates this L-shaped guide arrangement in detail.

As indicated in FIG. 6A and in FIG. 7, each guide 64 is provided with a minute projection 66 which aids in securing the shunting device 42 within the holding block.

FIG. 9 is a plan view of the conductive shield 24 with the holding block 36 indicated in dashed lines. The four holes 40 which receive the lugs 38 of the holding block are indicated in their relative positions.

As is best illustrated in FIGS. 8 and 8A, the shunting device 42 comprises a printed circuit board 70 having planar surfaces on opposite sides. On one planar surface 52 are deposited four contact pads 54, which come in contact with the contact tongues of the connector in the manner described above. On the opposite side of the printed circuit board are deposited two shunting wires, 72 and 74 which interconnect alternate ones of the pads 54. A shunting circuit is thus provided between the first and third and the second and fourth electrical terminals, respectively. Preferably, the wires 72 and 74 make contact with their respective contact pads through openings or holes through the printed circuit board 70.

There has thus been shown and described a novel electrical connector which fulfills all the objects and advantages sought therefor. Many changes, modifications, variations and other uses and applications of the subject invention will, however, become apparent to those skilled in the art after considering this specification and the accompanying drawings which disclose the preferred embodiment thereof. All such changes, modifications, variations and other uses and applications which do not depart from the spirit and scope of the invention are deemed to be covered by the invention, which is to be limited only by the claims which follow.

What is claimed is:

1. A shielded electrical connector for mating with a complementary electrical connector, said shielded connector comprising:

(a) an insulating terminal housing formed of a base member and a cover member, said housing having a front mating face, a rear wire-connecting face and a terminal supporting platform extending between the faces;

(b) a plurality of electrical terminals mounted on the terminal supporting platform with contact portions disposed in the area of the mating face and wire-connecting portions disposed in the area of the wire-connecting face, each contact portion comprising a resilient contact tongue spaced from said platform and having a free end extending away from said mating face, each contact tongue being matable against a corresponding contact tongue of the complementary connector to urge the contact tongues toward the respective platforms from which they are supported;

(c) electrical shunt means fixedly mounted in said housing and disposed adjacent to said contact tongues in the area of the free ends thereof, said shunt means engaging preselected contact tongues when said connector is in an unmated condition and being spaced from said preselected contact tongues when said connector is in a mated condition, said shunt means comprising an insulative, substantially planar surface having a plurality of conductive contact pads arranged thereon on a common straight line and facing said terminals, with each contact pad oriented adjacent a respective one of said contact tongues such that the area of contact between each pad and its respective, adjacent contact tongue is made in substantially the same relative position on all contact tongues, with the contact areas arranged on a common line; and (d) conductive electrical shield means attached to said base member and said cover member of said housing, said shield means having contact portions which are matable with complementary contact portions of the electrical shield means of a complementary connector.

2. The electrical connector defined in claim 1, wherein said shunt means further comprises conductor means for electrically connecting together selected ones of said contact pads.

3. The electrical connector defined in claim 2, wherein said planar surface is formed by a planar substrate and wherein said conductor means is disposed on the opposite side of said substrate than said contact pads.

4. A shielded electrical connector for mating with a complementary electrical connector, said shielded connector comprising:

(a) an insulating terminal housing formed of a base member and a cover member, said housing having a front mating face, a rear wire connecting face and a terminal supporting platform extending between the faces;

(b) a plurality of electrical terminals mounted on th e terminal supporting platform with contact portions disposed in the are of the mating face and wire connecting portions disposed in the area of the wire connecting face, each contact portion comprising a resilient contact tongue spaced from said platform and having a free end extending away from said mating face, each contact tongue being matable against a corresponding contact tongue of the complementary connector to urge the contact tongues toward the respective platforms from which they are supported;

(c) electrical shunt means fixedly mounted in said housing and disposed adjacent to said contact tongues in the area of the free ends thereof, said shunt means engaging preselected contact tongues when said connector is in an unmated condition and being spaced from said preselected contact tongues when said connector is in a mated condition, said shunt means comprising an insulative, substantially planar printed circuit board having a plurality of conductive contact pads arranged thereon facing said terminals, with each contact pad oriented adjacent a respective one of said contact tongues such that contact between each pad and its respective, adjacent contact tongue is made in substantially the same relative position on all contact tongues, said shunt means further comprising conductor mean, disposed on the opposite side of said circuit board than said contact pads, for electrically connecting together selected ones of said contact pads; and (d) conductive electrical shield means attached to said base member and said cover member of said housing, said shield means having contact portions which are matable with complementary contact portions of the electrical shield means of a complementary connector.

5. The electrical connector defined in claim 4, wherein said conductor means extends through holes in said circuit board to make connection to said contact pads.

6. A shielded electrical connector for mating with a complementary electrical connector, said shielded connector comprising:

(a) an insulating terminal housing formed of a base member and a cover member, said housing having a front mating face, a rear wire connecting face and a terminal supporting platform extending between the faces;

(b) a plurality of electrical terminals mounted on the terminal supporting platform with contact portions disposed in the area of the mating face and wire connecting portions disposed in the area of the wire connecting face, each wire connecting portion having an insulation displacement portion for making electrical engagement with an insulation-covered wire;

(c) conductive electrical shield means having a first portion attached to said base member and a second portion attached to said cover member of said housing, said shield means having contact portions which are matable with complementary contact portions of the electrical shield means of a complementary connector; and (d) an electrically insulative wire holding block attached to said second portion of said shield means for holding the insulated wires of an electrical cable during attachment to said wire connecting portions, said block including a plurality of wire retention means for receiving and holding said cable wires therein, said block being adapted to dispose wires therein individually into mechanical and electrical engagement with said wire connecting portions of said terminals upon joining said cover member with said base member.

7. The electrical connector defined in claim 6, wherein said holding block includes at least one plug-shaped projection that extends though an opening in said second portion of said shield means, the end of said projection being upset to form a firm connection to said shield means.

8. The electrical connector defined in claim 6, wherein each contact portion comprises a resilient contact tongue spaced from said platform and having a free end extending away from said mating face, each contact tongue being matable against a corresponding contact tongue of the complementary connector to urge the contact tongues toward the respective platforms from which they are supported; wherein said electrical connector further comprises electrical shunt means fixedly mounted on said holding block and disposed adjacent to said contact tongues in the area of the free ends thereof, said shunt means engaging preselected contact tongues when said connector is in an unmated condition and being spaced from said preselected contact tongues when said connector is in a mated condition, said shunt means comprising an insulative, substantially planar surface having a plurality of conductive contact pads arranged thereon facing said terminals, with each contact pad oriented adjacent a respective one of said contact tongues.

9. The electrical connector defined in claim 8, wherein each contact pad is oriented adjacent a respective one of said contact tongues such that contact between each pad and its respective, adjacent contact tongue is made in substantially the same relative position on all contact tongues.

10. The electrical connector defined in claim 9, wherein said shunt means further comprises conductor means for electrically connecting together selected ones of said contact pads.

11. The electrical connector defined in claim 10, wherein said planar surface is formed by a planar substrate and wherein said conductor means is disposed on the opposite side of said substrate than said contact pads.

12. The electrical connector defined in claim 11, wherein said conductor means extends through holes in said substrate to make connection to said contact pads.

13. The electrical connector defined in claim 11, wherein said planar substrate is a printed circuit board.

14. The electrical connector defined in claim 13, wherein said printed circuit board is retained in a slot on both sides of said holding block.

15. The electrical connector defined in claim 14, wherein said printed circuit board is retained by a detent in each slot.

* * * * *